United States Patent [19]

McIntyre

[11] Patent Number: 4,770,909

[45] Date of Patent: Sep. 13, 1988

[54] POROUS ROLL FLUID COATING APPLICATOR AND METHOD

[75] Inventor: Frederic S. McIntyre, Wellesley, Mass.

[73] Assignee: Acumeter Laboratories, Inc., Marlborough, Mass.

[21] Appl. No.: 112,044

[22] Filed: Oct. 16, 1987

Related U.S. Application Data

[63] Continuation of Ser. No. 835,050, Feb. 28, 1986, abandoned.

[51] Int. Cl.[4] ..... B05D 1/40; B05D 1/26

[52] U.S. Cl. ..... 427/428; 29/121.3; 118/259; 118/262; 118/246

[58] Field of Search ..... 29/121.3; 118/202, 259, 118/262, 249; 101/116, 127, 114; 427/428

[56] References Cited

U.S. PATENT DOCUMENTS

| | | | |
|---|---|---|---|
| 78,288 | 5/1868 | Holliday | 101/116 |
| 1,438,408 | 12/1922 | Strawn | 118/262 |
| 2,292,602 | 8/1942 | Biondi | 101/116 |
| 3,033,702 | 5/1962 | Fenselau | 101/116 |
| 3,152,011 | 10/1964 | Gerard | 118/211 |
| 3,294,060 | 12/1966 | McIntyre et al. | 118/261 |
| 3,408,984 | 11/1968 | Pallins | 118/259 |
| 3,595,204 | 7/1970 | McIntyre | 118/8 |
| 3,628,982 | 12/1971 | Krug | 118/202 X |
| 3,759,800 | 9/1973 | Reinke | 101/127 x |
| 3,812,820 | 5/1974 | Ronneberg | 118/259 X |
| 3,915,087 | 10/1975 | Tiemann | 101/116 |
| 4,277,301 | 7/1981 | McIntyre | 156/446 |
| 4,368,688 | 1/1983 | Grumer et al. | 118/325 |
| 4,565,217 | 1/1986 | McIntyre | 137/625 |

*Primary Examiner*—Shrive P. Beck

*Attorney, Agent, or Firm*—Rines and Rines

[57] ABSTRACT

Metered application of coating materials, ranging from room temperature to hot melt coatings and adhesives, through the use of fluid-porous roll applicators operating singly or in multiple units for transfer or direct coating, including simultaneous continuous or intermittent patterns and simultaneous different weight pattern coatings or different material coatings.

29 Claims, 6 Drawing Sheets

POROUS ROLL FLUID COATING APPLICATOR AND METHOD

This is a continuation application of Ser. No. 835,050 filed Feb. 28, 1986, which is now abandoned.

The present invention relates to methods of and apparatus for applying or coating fluid materials, including but not restricted to hot melt type liquids and adhesives of a wide variety of viscosities, to surfaces (hereinafter generically referred to as webs), being more particularly directed to such coating with the aid of novel porous roll surfaces and the like.

Various types of hot melt and other fluid apparatus and coaters have been heretofore employed to provide continuous, intermittent and patterned coatings upon web surfaces, including slot nozzle applicators employed with metered pumped fluid supply systems, as described in my earlier U.S. Pat. Nos. 3,595,204, and 4,277,301, and commutating cylindrical apparatus as in U.S. Pat. No. 3,294,060.

Underlying the present invention, however, is the discovery that great flexibility in coating can be obtained through metering the fluid through a porous cylindrical shell or roll, enabling both ready direct and indirect or transfer coating of one or multiple hot melt or room temperature fluids, including hot melts of high viscosity, and with reduced pressure drops over prior art techniques, and in continuous, intermittent or patterned coatings at will.

An object of the present invention is to employ the features of this discovery to provide, accordingly, a novel method of and apparatus for fluid application that enables such and other improved operation through the use of porous roll fluid-metering coating.

A further object is to provide such a new and improved coating applicator that enables, also, simultaneous pattern coatings and stripes of different fluid coat weights; continuous, pattern and stripe simultaneous coatings of dissimilar fluid coating materials; and successive and superimposed fluid coatings.

Other and further objects will be explained hereinafter, such being more particularly delineated in the appended claims.

In summary, from one of its broad viewpoints, the invention embraces a method of coating a web with fluid material, that comprises, pumping such fluid material with one of continuous and intermittent metered flow along a predetermined longitudinal path, exiting the same at a region transverse thereto, receiving the transversely exited fluid in a reservoir volume extending along and enveloping said path, exiting the fluid from said reservoir volume through a porous surface co-extensive with and bounding said reservoir volume, relatively rotating the said porous surface and the said region of fluid exiting from said path, and applying the fluid longitudinally exited through the porous surface to said web while moving the web transversely past the same to coat the web with the fluid as metered through the pores of the porous surface. In apparatus form, the invention contemplates fluid coating apparatus having, in combination, means for continuously or intermittently pumping the coating fluid along a longitudinally extending conduit terminating in an opening adjusted for transversely exiting the fluid, a cylindrical annular reservoir volume enveloping the conduit and its opening for receiving the exited fluid, a cylindrical porous shell externally bounding the cylindrical reservoir to constitute a fluid dispensing roll, means for relatively rotating the conduit and its fluid exiting opening and the roll to cylindrically distribute the exited fluid along the reservoir volume, and means for rotating said roll and applying the fluid dispensed through the porous shell to web means drawn transversely past the roll. Preferred and best mode embodiments and modifications are hereinafter detailed.

The invention will now be described with reference to the accompanying drawings, FIGS. 1A and B of which are isometric (exploded) and transverse sectional views of a novel porous roll applicator designed for use in accordance with the present invention;

Figure 1B:
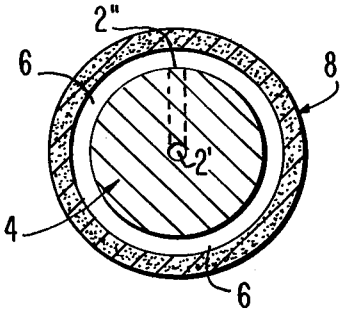
Figure 1A:
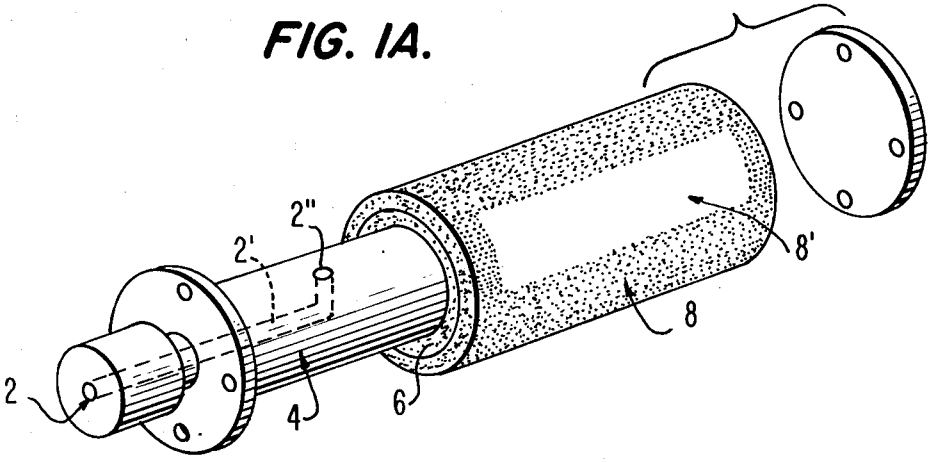
Figure 3A:
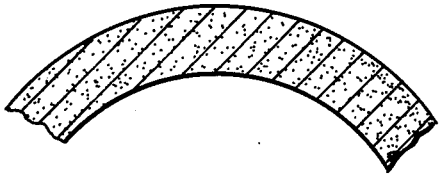
FIGS. 3A and 3B are transverse fragmentary sections, upon an enlarged scale, of standard and differential porosity (micron) weight porous shells for the applicator.
Figure 3B:
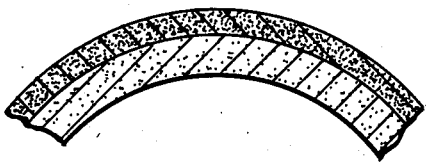
Figure 4A:
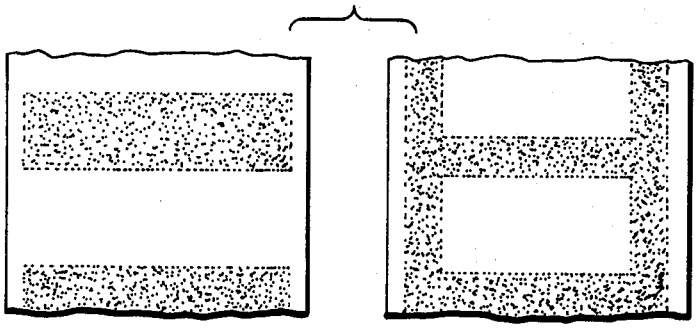
FIGS. 4A and 4B show, respectively, illustrative single and multiple width repeat coating patterns attainable with apparatus of the type shown in FIGS. 1A and 2.

Referring to FIGS. 1A and 1B, a preferred porous roll applicator construction is illustrated for continuously or intermittently pumping the coating fluid from a single supply port at a rotary joint union 2 along a longitudinally extending conduit 2′ terminating in a transversely radially extending opening 2″ within a cylindrical inner supply roll conduit 4—the inlet 2′ extending preferably axially along the roll 4 and the opening 2″ exiting fluid transversely therefrom. A coaxial cylindrical annular reservoir cavity or volume 6 envelops the inner roll conduit 4 and receives the exited fluid at 2″. The reservoir volume 4 is coaxially externally bounded by a cylindrical porous shell 8, as of sintered metal, screening or the like, as later more fully described, with the conduit 4 and its fluid exiting opening 2″ being relatively rotatable to distribute the fluid within and along the reservoir to keep the same filled and applying fluid uniformly longitudinally along the porous shell 8. The porous shell may, for example, be of uniform sintered metal construction, say 20 micron pores, as in FIG. 3A, or may employ multiple varying or different porosity (and weight) shells as in FIG. 3B, such as a 10 micron outer shell occupying, say, 10% of the total shell thickness, and a 100 micron inner concentrate shell portion of 100 microns, constituting the balance of the shell thickness. The differential micron construction will reduce the pressure drop for high viscosity materials such as 10,000–30,000 cps at room temperature, when metered through the porous metal shell. The outer surface of the porous shell roll 8 may be varied not only in degree of porosity, but also in surface preparation or extent, as at 8' in FIG. 1A, to introduce predetermined patterns in the coating, such as the repeat coating horizontal stripes or longitudinal side stripes and intermittent horizontal stripes of FIG. 4A. The patterns may be metered into the surface of the roll by special etching after the surface pores have been machined closed.

Figure 5A:
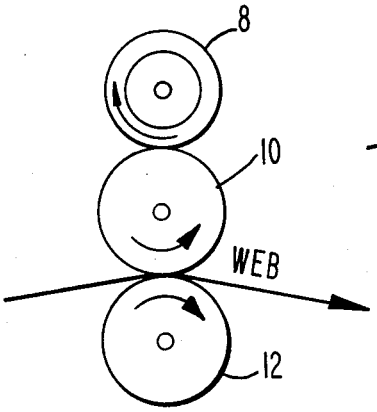
FIGS. 5A, 5B and 5C are schematic side elevations of typical applicator configurations useful with the invention for transfer, direct and differential or different material coatings, respectively.
Figure 5B:
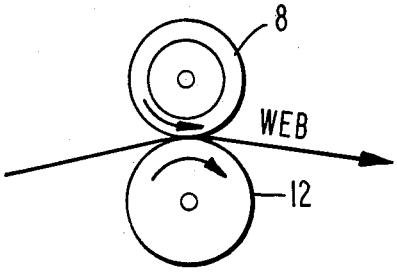

While porous sintered metal cylinders have heretofore been used for the very different applications of air film as bearing rolls, wicks and filter cartridges and the like, suitable sintered stainless steel, Monel and similar porosities of 10, 20 or 40 microns in shell thickness of the order of ⅜ inch have been successfully employed for this very different usage as a viscous fluid metering coating roll. Among such are the Series 1400 of Mott Metallurgical Corporation of Farmington, Conn. This unique usage is more clearly delineated in FIGS. 5A and 5B, showing the porous apparatus roll 8 used for transfer and direct coating to moving webs, respectively. In FIG. 5A, the porous roll 8 is rotated in contact with a rubber-coated steel mandrel or similar applicating roll 10 that transfers the coating fluid from the porous dispensing roll 8 to the web (so-labelled) as it moves between the roll 10 and the lower laminating roll 12, rotating oppositely to the roll 10. The laminating roll insures positive web contact against the applicating roll for fluid transfer. The porous roll 8 rotates oppositely to the transfer or applicating roll 10 and preferably either with the same surface speed thereof or synchronously therewith, or proportional thereto (including fractional speed). The applicating roll operates at web speed or at a slightly less speed to create a smeared surface. Typical speed can be as low as 95% of web speed. In FIG. 5B, on the other hand, the porous roll 8 itself directly contacts the web as the same moves between the roll 8 and an oppositely rotating lower laminating roll 12 which insures positive contact of the web with the porous roll. In such direct coating usage, the porous roll 8 runs synchronous to the web speed for pattern print coating; or at a slightly less speed for full width coating or continuous stripes (longitudinal in web direction) to create a smeared surface. The systems of FIGS. 5A and 5B permit full, or continuous, stripe and pattern coatings in single weight coats.

Figure 7A:
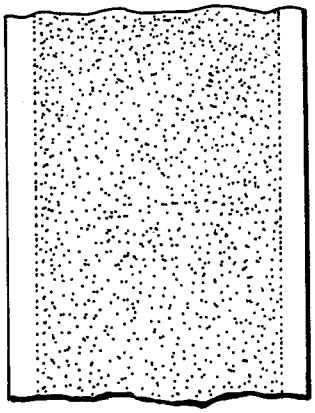
Figure 7B:
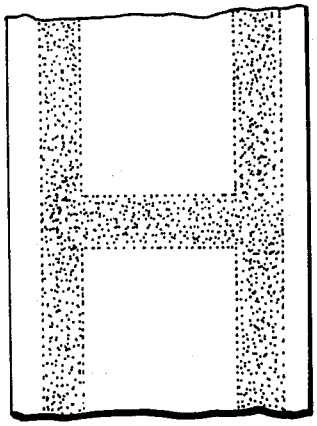
Figure 6:
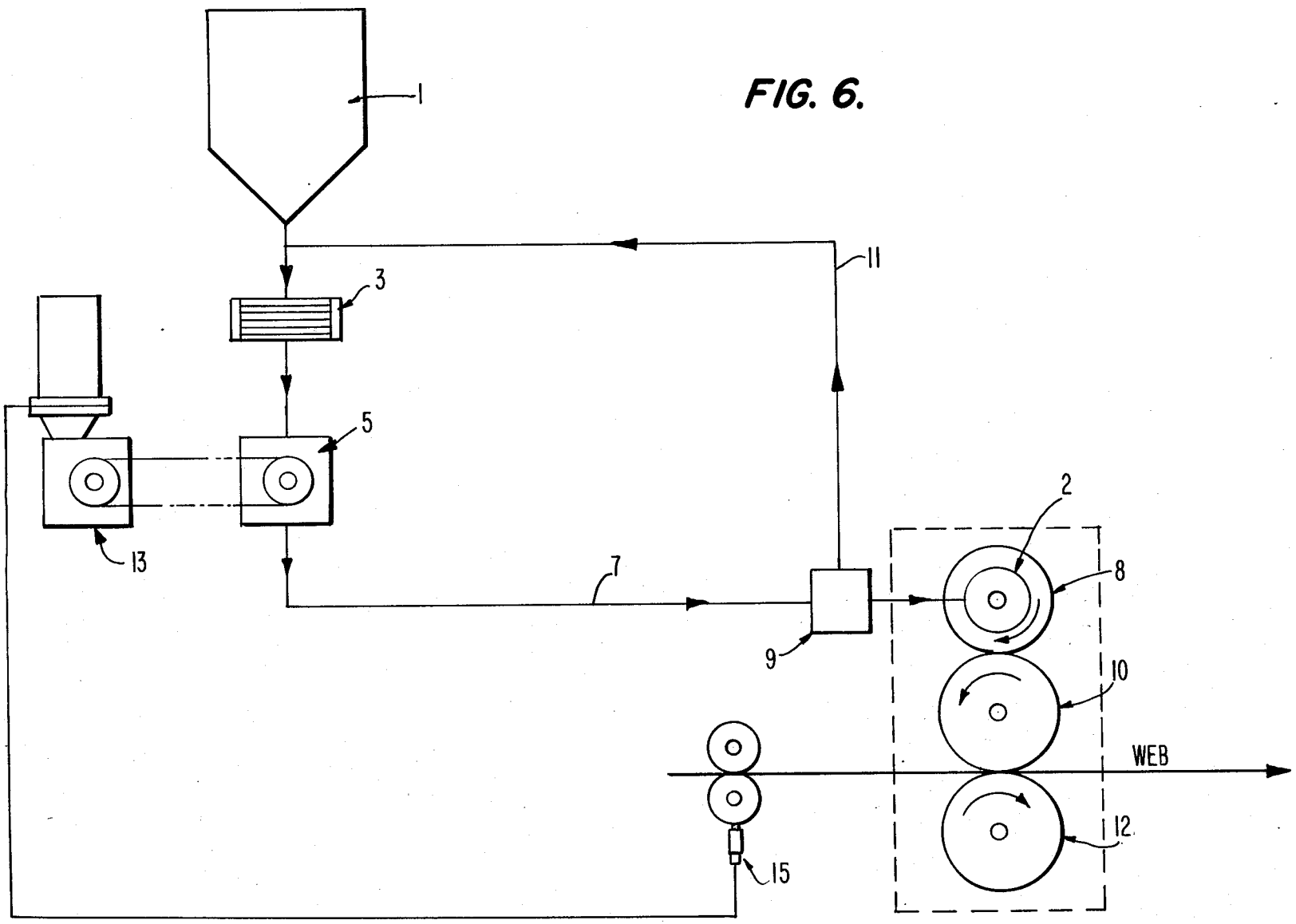
FIG. 6 is a more detailed system diagram for such transfer and/or direct coating, suitable for both continuous full coating (FIG. 7A) and patterns such as continuous longitudinal stripes with intermittent transverse stripes (FIG. 7B)

A more complete system for that schematically shown in FIG. 5A is shown in FIG. 6 applied to the illustrative example of hot melt adhesives as of the types described in said patents or other well-known coatings of this type, fed from a hopper 1 through a filter 3 to a positive displacement metering pump 5 (such as that of said patents) to supply fluid at 7 to a three-way valve 9 (as, for example, of the type described in my U.S. Pat. No. 4,565,217) that supplies the rotary union inlet 2 of the porous roll system 8. A return feed back to the filter input is shown at 11. The metering pump 5 is controlled by a digital pump drive 13 which is connected to a web reference magnetic pick up sensor 15 contacting the web to synchronize the pump speed with the web speed. Examples of full or continuous coatings and continuous longitudinal stripe and intermittent horizontal stripe patterns are shown in FIGS. 7A and 7B.

Figure 2:
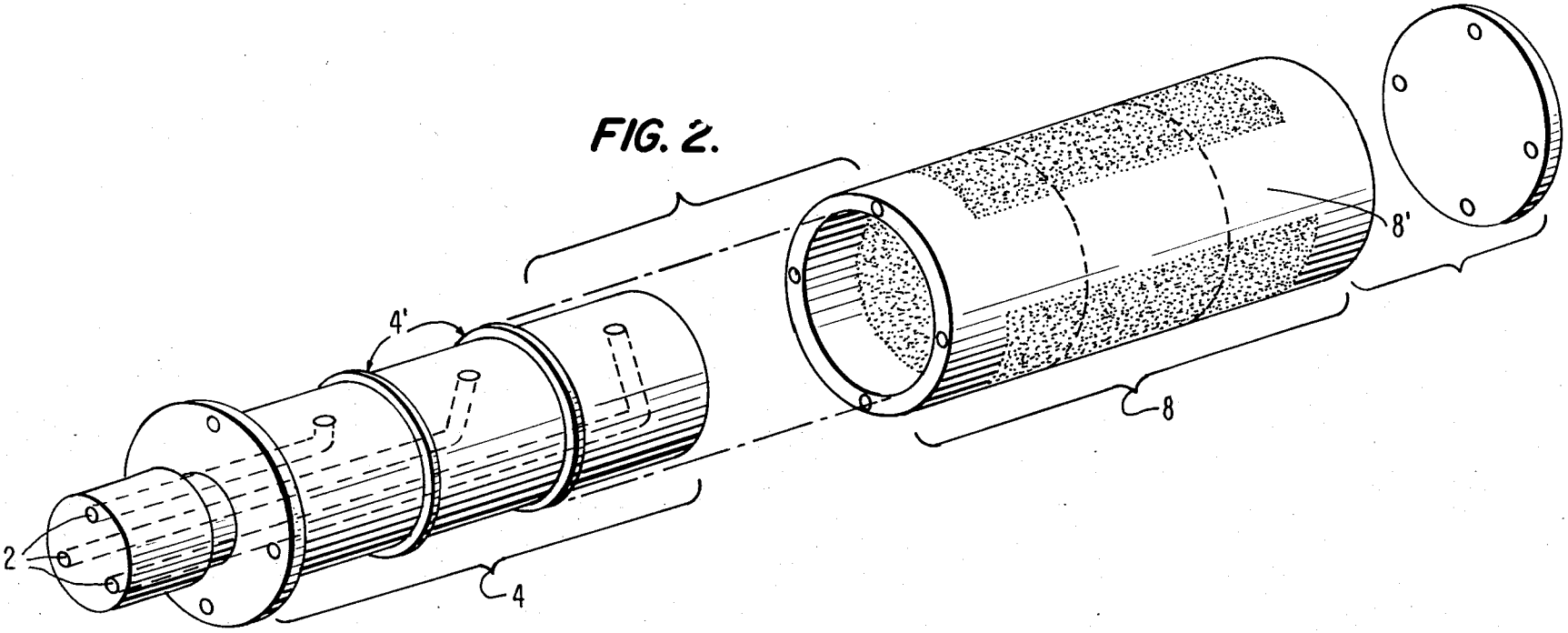
FIG. 2 is a view similar to FIG. 1A of a modified multiple section porous roll applicator.
Figure 4B:
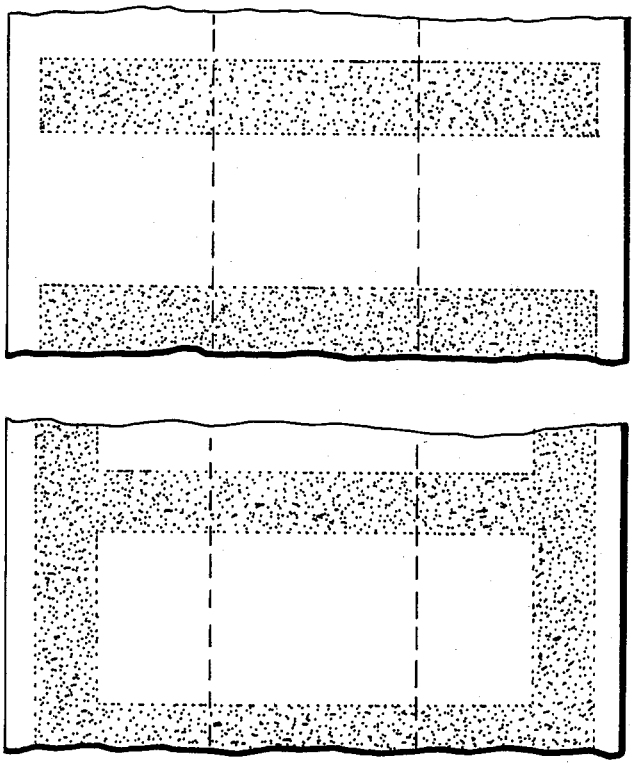

Multiple width porous roll applicators may also be provided as shown in FIG. 2, illustrating multiple inlet supply ports and rotary union 2, multiple width successive inner supply rolls 4, with successive section separators 4' between adjacent rolls separating the respective successive reservoir cavities and porous roll shell sections. FIG. 4B illustrates typical exemplary multiple width repeat coating patterns.

Figure 5C:
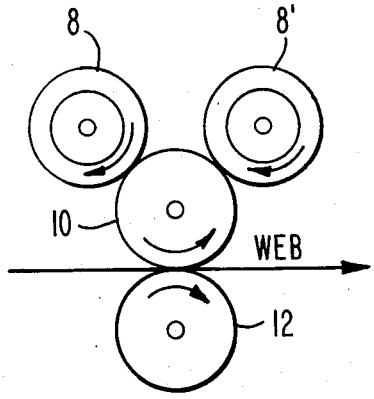

Turning to the before-mentioned flexibility of the invention to enable stripe or other pattern coatings of different coat weights simultaneously or full, stripe or pattern coatings of dissimilar fluid coating materials simultaneously, reference is made to the schematic application modification of FIG. 5C, dealing with such differential or different material coatings. This design would permit stripes or pattern coatings of different coat weights simultaneously. The combination of two porous rolls permits applying layer upon layer of two identical or dissimilar fluids side by side, or the same fluid applied at different coat weights, to meet a specific customer coating pattern. In FIG. 5C, the porous roll 8 (with a pattern #1, for example) is shown contacting one upper side portion of the oppositely rotating applicator roll 10 between which and the laminating roll 12, the web is moved. A second porous roll 8' (pattern #2 or different coating weight or material, for example) simultaneously contacts the opposite side of the applicator roll 10. The porous rolls 8 and 8' can run synchronously with or at fractional differential speed to the applicating roll 10 which, in turn, may, if desired, run at a fractional differential speed to that of the web.

Figure 9:
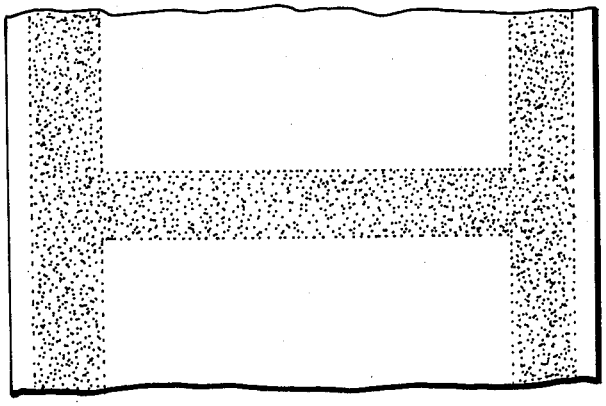
Figure 8:
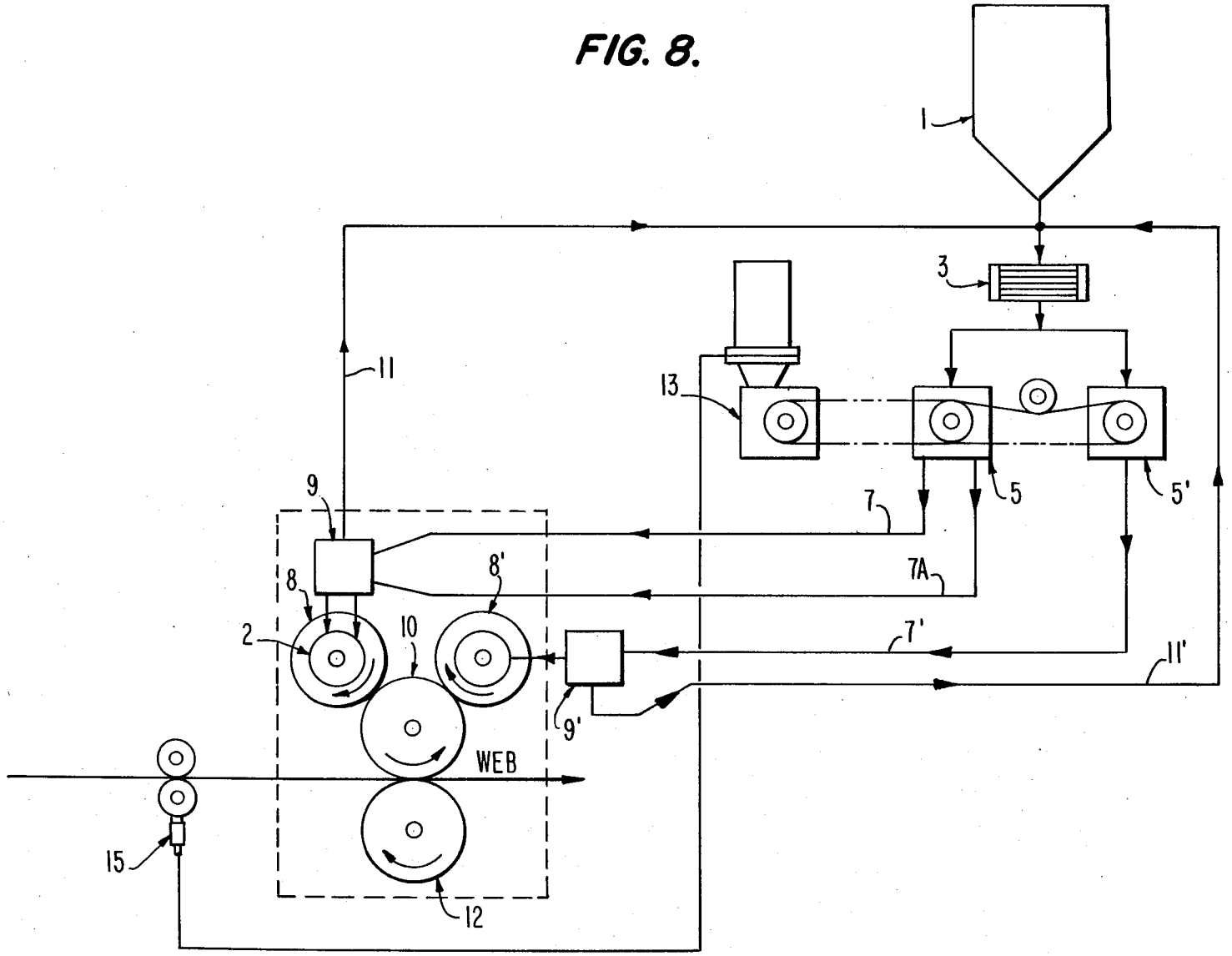
FIG. 8 is a system diagram similar to FIG. 6 of a multiple supply, differential or different material coating system suitable for pattern coatings of intermittent, differential stripe and/or continuous stripe coatings (FIG. 9)

A complete system for such different material or differential operation is shown in FIG. 8, wherein the second porous roll 8' is shown fed from a second positive displacement metering pump 5', feeding at 7' a second 3-way valve 9' for inputting the second porous roll assembly 8', and with a return line 11' to the input of the filter 3. The pump 5 feeding the porous roll 8 is shown as a dual discharge metering pump with supply lines 7 and 7A. FIG. 9 illustrates an exemplary pattern coating of intermittent differential weight stripe (supply line 7'—say, 2 mil coating) and continuous longitudinal side stripes (supply lines 7 and 7A—say, 1 mil coating).

Figure 10:
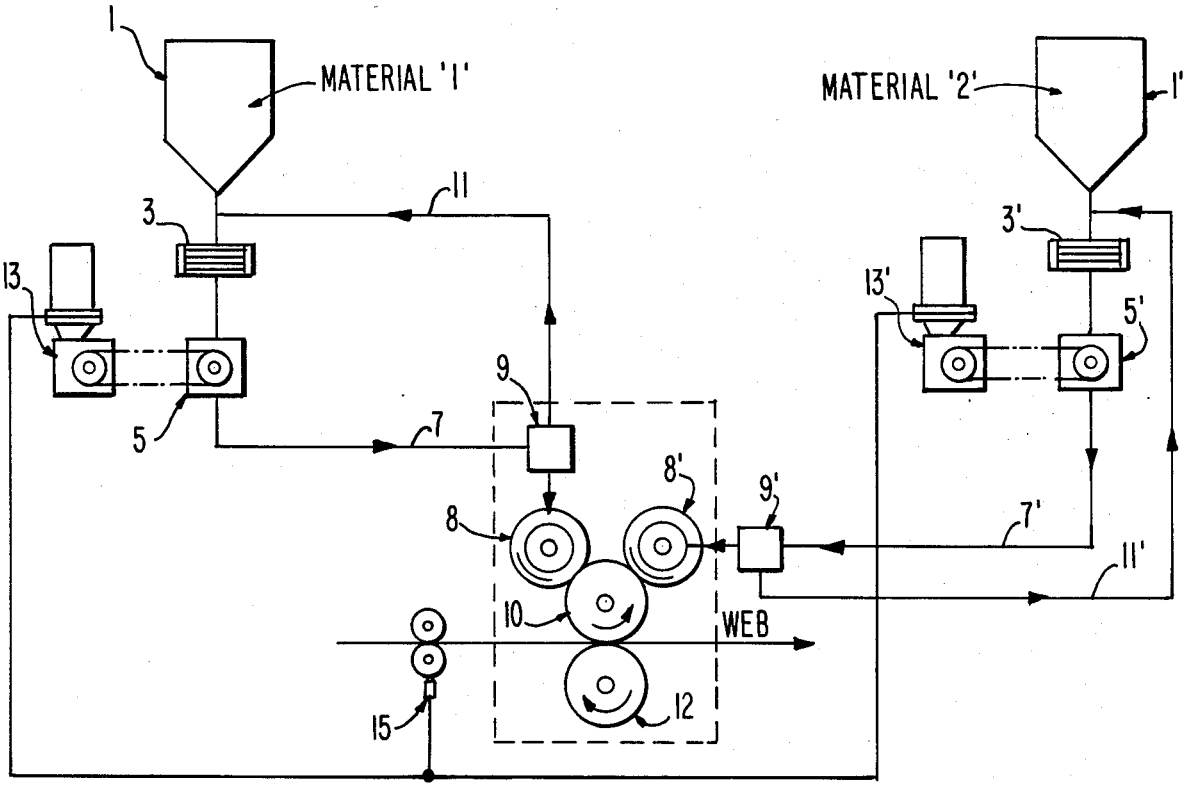
FIG. 10 is a similar system diagram for a modified multiple supply system suitable for full coating of two different materials, such as one over another (FIG. 11).
Figure 11:
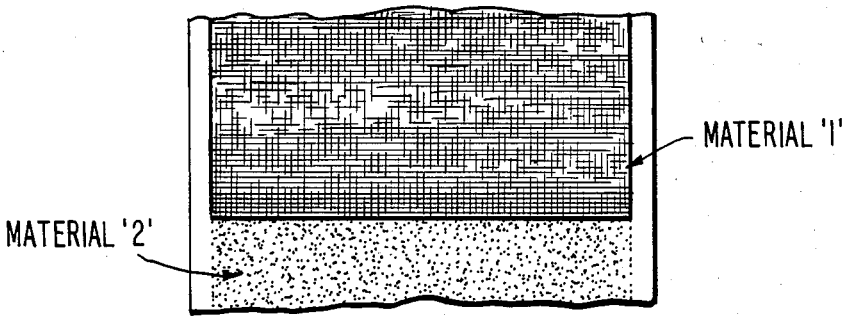

As previously noted, the flexibility of the invention also extends to multiple coatings of two different fluid coating materials, one over the other as in FIG. 11. The system of FIG. 10 enables this with a structure similar to that of FIG. 8, but involving separate material hoppers 1 and 1' and pumps 5 and 5', as shown for the different fluid materials.

The porous roll applicating technique of the invention is useful with room-temperature liquids and with hot melt type liquids, at operating temperatures of 350° F., and fluid coating applications of other temperature ranges. This can be accomplished by installing heating elements within the porous roll assembly, or using the porous metal material 8 as an electrical conductor/resistor, receiving heating current. Typical material used for resistance heat would be Nichrome metal.

Industrial applications for hot melt pattern coatings are required, for example, in the cigarette industry. Typically, the attachment of the filter covering paper, known as tipping paper, joining the filter element to the cigarette, requires parameter/rectangular adhesive pattern with the center area open, without adhesive. Present cigarette making machines are operating up to 7,000 cigarettes per minute, which represents the drying limitation of conventional polyvinyl resin adhesive. Any further increase in line speed prevents succesful adhesive attachment and drying of the cigarette components. Hot melt coating used with the present invention in place of the resin adhesive permits a further increase in production speed. The hot melt will be applied at a low coating thickness, such as 1 mil, in order to obtain satisfactory bond of the cigarette components.

In addition to coatings previously described, the invention is particularly useful with room temperature materials such as silicones, polyvinyl acetates and other adhesive coatings, and with hot melts such as the etholene vinyl package sealing materials.

Further modifications will also occur to those skilled in this art, and such are considered to fall within the spirit and scope of the present invention as defined in the appended claims.

What is claimed is:

1. A method of coating a moving web with fluid material, that comprises, providing a rotatable, hollow, cylindrical, microporous-surface roll, providing internally of said roll and coextensive therewith a cylindrical reservoir volume bounded by said roll, said reservoir volume being an annulus extending between said cylindrical roll and an inner cylindrical member coaxial therewith, said inner cylindrical member having a diameter that is a major portion of the inner diameter of said roll, pumping fluid material with metered flow into said reservoir volume, the rate of said metered flow being controlled in accordance with the rate of movement of said web, whereby fluid pressure is maintained in said reservoir volume dependent upon the rate of movement of said web, exiting said fluid material from said reservoir volume only through said microporous surface of said roll, rotating said roll, and applying said fluid material from said microporous surface of said roll to said web.

2. A method as claimed in claim 1 and in which said fluid material is pumped along a predetermined path extending longitudinally within said roll and then transversely into said reservoir volume.

3. A method as claimed in claim 1 and in which said applying is effected by contacting the moving web with the porous surface roll while rotating the roll.

4. A method as claimed in claim 3 and in which said web is moved between oppositely rotating porous surface and laminating rolls.

5. A method as claimed in claim 3 and in which said porous surface roll is rotating at a speed substantially synchronous with the web speed or proportional thereto.

6. A method as claimed in claim 1 and in which said applying is effected by contacting said porous surface roll with an oppositely rotating applicating roll that contacts the web and transfers the fluid exiting said pores and carried by said applicating roll to the web.

7. A method as claimed in claim 6 and in which said porous surface and applicating rolls are rotated at substantially synchronous speed or proportional thereto.

8. A method as claimed in claim 6 and in which the porous surface roll and applicating roll are relatively rotated to run at one of substantially synchronous and fractional differential speeds, and said applicating roll is rotated to run at one of substantially synchronous and fractional differential speeds relative to the web speed.

9. A method as claimed in claim 6 adapted for multiple coatings and in which a second fluid ejecting porous surface roll is simultaneously rotated in contact with the applicating roll at a different point of contact than the first-named porous surface roll to coat the web with the second fluid.

10. A method as claimed in claim 9 and in which the second porous surface roll is rotated to run at one of substantially synchronous and fractional differential speeds relative to the applicating roll.

11. A method as claimed in claim 6 and in which a second fluid ejecting porous surface roll is employed substantially simultaneously to coat the web with the second fluid.

12. A method as claimed in claim 11 and in which the fluids are selected and the rotation speeds of said rolls are adjusted to produce at least one of simultaneous pattern coatings and stripes of different fluid coat weights; continuous, pattern and stripe simultaneous coatings of dissimilar fluid coating materials; and successive and superimposed fluid coatings.

13. A method as claimed in claim 11 and in which the porosity pattern on the porous roll surfaces is varied in at least one of surface extent and degree to produce different coating pattern portions along the web from the first and second fluids.

14. A method as claimed in claim 13 and in which at least one of said porous surfaces is patterned with porous sections to produce at least one of longitudinal and transverse spaced coating stripes.

15. A method as claimed in claim 1 and in which the porosity of said porous surface varies in at least one of surface extent and degree of porosity in accordance with a predetermined pattern to provide a patterned coating.

16. A method as claimed in claim 15 and in which said porosity is provided at spaced portions only of said porous surface to provide spaced stripe coatings.

17. A method as claimed in claim 1 and in which said porous surface is heated to enable the dispensing of hot melt fluids and the like from a source of the same feeding along said path.

18. A method as claimed in claim 17 and in which said porous surface is of electrically conducting material and the heating is effected by passing electrical current therealong.

19. A method as claimed in claim 18 and in which the porous surface temperature is monitored and the current is controlled in accordance therewith.

20. Fluid coating apparatus comprising a rotatable fluid dispensing roll having a microporous shell, a cylindrical annular reservoir volume extending co-extensively within said roll and bounded by said shell, said reservoir volume extending between said shell and an inner cylindrical member coaxial therewith and said inner cylindrical member having a diameter that is a major portion of the inner diameter of said shell, metering pump means for continuously or intermittently pumping fluid into said reservoir volume and through the pores of said shell under pressure, the pores of said shell constituting the only fluid exit from said reservoir volume, and means for rotating said roll and applying the fluid dispensed through the microporous shell to web means drawn transversely past the roll, said metering pump means having means for controlling the rate at which said fluid is pumped into said reservoir volume in accordance with the rate at which said web means is drawn transversely past the roll, whereby the pressure in said reservoir volume is dependent upon the rate at which said web means is drawn transversely past the roll.

21. Apparatus as claimed in claim 20 and in which said metering pump means pumps said fluid along a predetermined path extending longitudinally within said shell and transversely into said reservoir volume.

22. Apparatus as claimed in claim 20 and in which the applying means comprises means for directly contacting the porous shell of the roll with one surface of the web at a region where a cooperative roll engages the opposite surface, to fluid coat the said one surface of the web.

23. Apparatus as claimed in claim 20 and in which the applying means comprises applicator roll means contacting the porous shell roll and rotating oppositely to the rotation of the same, the applicator roll means contacting one surface of the web at a region where a cooperative roll engages the opposite surface, to transfer the fluid dispensed through the porous shell to coat said one surface of the web.

24. Apparatus as claimed in claim 23 and in which a further fluid-dispensing porous shell roll is provided contacting the applicator roll means at a different location from contact with the first-named porous shell roll and simultaneously therewith to provide a further fluid coating on the web.

25. Apparatus as claimed in claim 23 and in which the fluid and roll rotation rates are selected to produce on the web at least one of simultaneous pattern coatings and stripes of different fluid coat weights; continuous, pattern and stripe simultaneous coatings of dissimilar fluid coating materials; and successive and superimposed fluid coatings.

26. Apparatus as claimed in claim 20 and in which the porous shell is patterned to provide one of spaced porous sections and variations in dimensional extent and degree of porosity.

27. Apparatus as claimed in claim 20 and in which the porous shell is constructed of one of sintered metal and screening.

28. A method of coating a web with fluid material, that comprises, pumping such fluid material with one of continuous and intermittent metered flow along a predetermined longitudinal path, exiting the same at a region transverse thereto, receiving the transversely exited fluid in a reservoir volume extending along and enveloping said path, exiting the fluid from said reservoir volume through a porous surface co-extensive with and bounding said reservoir volume, relatively rotating the said porous surface and the said region of fluid exiting from said path, and applying the fluid longitudinally exited through the porous surface to said web while moving the web transversely past the same to coat the web with the fluid as metered through the pores of the porous surface, and in which the further steps are performed of providing a plurality of fluid paths for pumped fluid each transversely exiting its fluid at successively longitudinal regions, dividing the reservoir volume into a corresponding plurality of successive longitudinal sections each having its enveloping porous surface and each sealed from one another, each one corresponding to and receiving fluid from its corresponding fluid path.

29. Fluid coating apparatus having, in combination, means for continuously or intermittently pumping the coating fluid along a longitudinally extending conduit terminating in an opening adjusted for transversely exiting the fluid, a cylindrical annular reservoir volume enveloping the conduit and its opening for receiving the exited fluid, a cylindrical porous shell externally bounding the cylindrical reservoir to constitute a fluid dispensing roll, means for relatively rotating the conduit and its fluid exiting opening and the roll to cylindrically distribute the exited fluid along the reservoir volume, and means for rotating said roll and applying the fluid dispensed through the porous shell to web means drawn transversely past the roll, and in which a plurality of longitudinally extending coating fluid conduit means is provided each transversely exiting fluid at successive longitudinal regions into corresponding successive enveloping cylindrical annular reservoir sections having corresponding porous shells, and means being provided for sealing each section from the adjacent section.

* * * * *